US006878315B2

(12) United States Patent
Järvinen et al.

(10) Patent No.: US 6,878,315 B2
(45) Date of Patent: Apr. 12, 2005

(54) METHOD AND APPARATUS FOR CASTING A CONCRETE PRODUCT

(75) Inventors: Lassi Antero Järvinen, Valkeakoski (FI); Aimo Tapio Seppänen, Sääksmäki (FI)

(73) Assignee: Consolis Technology Oy AB, Vantaa (FI)

( * ) Notice: Subject to any disclaimer, the term of this patent is extended or adjusted under 35 U.S.C. 154(b) by 0 days.

(21) Appl. No.: 10/351,529

(22) Filed: Jan. 27, 2003

(65) Prior Publication Data

US 2003/0151153 A1 Aug. 14, 2003

(30) Foreign Application Priority Data

Feb. 1, 2002 (FI) ..... 20020193

(51) Int. Cl.[7] ..... B28B 23/06; B28B 23/18; B28B 3/22; B28B 3/24

(52) U.S. Cl. ..... 264/33; 264/35; 264/40.1; 264/209.1; 264/211.11; 264/228; 264/229; 425/64; 425/114; 425/145; 425/150

(58) Field of Search ..... 264/33, 35, 40.1, 264/70, 209.1, 211.11, 228, 229; 425/64, 114, 145, 150

(56) References Cited

U.S. PATENT DOCUMENTS

| | | | | | |
|---|---|---|---|---|---|
| 3,200,177 | A | * | 8/1965 | Dodd | 264/70 |
| 3,605,217 | A | | 9/1971 | Martens et al. | |
| 3,608,012 | A | | 9/1971 | Jonell et al. | |
| 4,290,991 | A | * | 9/1981 | Thim | 264/157 |
| 4,621,943 | A | * | 11/1986 | Swanson | 404/70 |
| 4,718,838 | A | * | 1/1988 | Ren et al. | 425/64 |
| 4,884,958 | A | * | 12/1989 | Lowndes, III et al. | 425/62 |
| 5,618,476 | A | * | 4/1997 | Mogel | 425/64 |
| 5,820,887 | A | * | 10/1998 | Mogel | 425/64 |
| 2003/0003173 | A1 | * | 1/2003 | Jarvinen et al. | 425/64 |
| 2003/0057597 | A1 | * | 3/2003 | Seppanen et al. | 264/228 |
| 2003/0227102 | A1 | * | 12/2003 | Sahala et al. | 264/86 |
| 2004/0051193 | A1 | * | 3/2004 | Seppanen | 264/33 |
| 2004/0201118 | A1 | * | 10/2004 | Jarvinen et al. | 264/33 |

FOREIGN PATENT DOCUMENTS

| | | |
|---|---|---|
| DE | 1036743 A1 | 8/1958 |
| GB | 1 391 008 A | 4/1975 |
| JP | 09 272110 A | 10/1997 |

OTHER PUBLICATIONS

English machine translation of JP–09–272110–A; Japanese Patent Office website; Jan. 2005.*

* cited by examiner

*Primary Examiner*—Michael P. Colaianni
*Assistant Examiner*—Michael I. Poe
(74) *Attorney, Agent, or Firm*—Burns, Doane, Swecker & Mathis, LLP

(57) ABSTRACT

A method and apparatus are for fabricating a concrete product in a slip-form casting process, in which method concrete mix is fed into a slip-form mold of a defined cross section moving progressively in the casting process so as to obtain a concrete product of a desired shape. The method includes an interruptible guidance control of the prestressing tendons so as to allow the tendon guides to travel past supplementary parts such as reinforcing steels connected to the prestressing tendons.

2 Claims, 2 Drawing Sheets

METHOD AND APPARATUS FOR CASTING A CONCRETE PRODUCT

FIELD OF THE INVENTION

The present invention relates to a method for continuous slip-form casting of prestressed concrete products so that the tendon guides of the casting machine are adapted to automatically travel past transverse reinforcing steels tied to the prestressing tendons and anchor and/or attachment plates that are located in the casting mold so as to become embedded in the cast concrete.

The invention also relates to a slip-form casting apparatus for casting prestressed concrete products, the apparatus including tendon guides capable of identifying and thus traveling past transverse reinforcing steels and attachment plates tied to the prestressing tendons, however, so as to keep the tendons controlledly in their predetermined positions.

BACKGROUND OF THE INVENTION

In an extruder-type slip-form casting machine, the concrete mix is forced by means of auger feeders through a casting mold or nozzles, whereby the casting machine is propelled by file reaction force generated by the auger feeders. The ready-cast product remains resting on the casting bed. The prestressing tendons are tensioned prior to casting and the correct location of the tendons in the concrete product being cast is secured by means of tendon guides following the progress of the casting operation. The guides support the prestressing tendons from all sides so as to keep them steady in the vertical and lateral directions against displacing forces that are invoked by the concrete mix extrusion pressure generated by the auger feeders.

In special cases, the prestressing tendons may have tied thereto transverse reinforcing steels or attachment plates placed against the wall of the casting mold. Transverse reinforcing steels may be needed, e.g., when a great number of openings must be provided in the concrete product being made. Attachment plates are employed, e.g., when the concrete product is to be attached on site to the steel frame of a building prior to the final reinforcement and post-grouting of joints, joining of concrete products to each other or the surface structures of an underlying ceiling must be adhered to the concrete products. The attachment plates may be connected to one or more prestressing tendons.

In manufacture of these special products, it is impossible to use conventional tendon guides that are designed to guide prestressing tendons in a passive fashion during the entire course of casting. Neither it is possible to secure the attachment plates to the casting bed for the travel of the casting machine thereover inasmuch as such fixed attachment plates would prevent the removal of the finished concrete product away from the casting bed. Conventional extruder-type slip-form casting machines are not suited for casting such prestressed concrete products that have their lower prestressing tendons tied to supplementary parts serving to locate prestressing tendons in predetermined position so that accessory locating equipment operating from outside the casting machine are not needed.

SUMMARY OF THE INVENTION

In the method according to the present invention, the positioning of prestressing tendons in a slip-form casting process may be carried out in spite of the supplementary parts connected thereto in a manner that leaves them embedded in the cast concrete. The method of the invention is capable of identifying the supplementary parts connected to the prestressing tendons during the progress of the casting run and thus allowing the tendon guides to avoid collision with such parts.

According to the method, the prestressing tendons are guided at tow or more successive points, whereby the unclamping of one tendon guide for moving the guide past the obstructing supplementary parts will not compromise the overall guidance of prestressing tendons inasmuch as the other tendon guides perform the guidance control of the prestressing tendons. The supplementary parts connected to the prestressing tendons are identified by an integral proximity sensor of the casting machine adapted to travel therewith as the casting operation proceeds. The sensor signal is utilized in the control of the tendon guide functions.

The method and apparatus according to the invention makes it possible to produce on an extruder-type slip-form casting machine such prestressed concrete products that includes supplementary parts connected to the prestressing tendons in a fashion that permits precise location of the prestressing tendons in predetermined positions in the cross section of the concrete product.

The present method and apparatus are also suitable for use in other types of slip-form casting machines such as, e.g., those designed for the slideformer slip-form casting technique or fabrication of a prestressed precast floor planks.

BRIEF DESCRIPTION OF THE DRAWINGS

Next, the invention will be examined in greater detail by making reference to the attached drawing, wherein.

DESCRIPTION OF THE PREFERRED EMBODIMENTS

Figure 1:
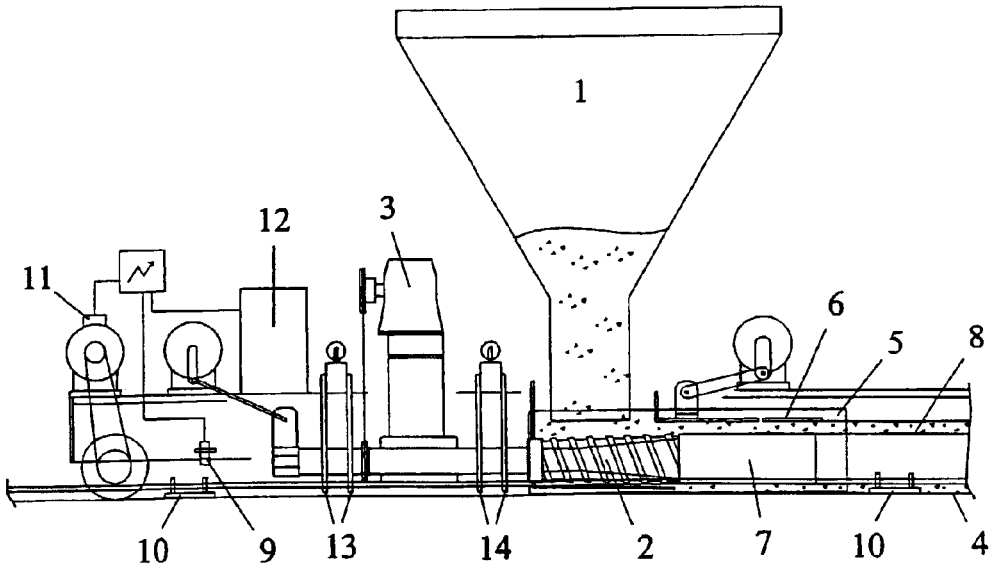
FIG. 1 shows a casting machine according to the invention.

Referring to FIG. 1, the apparatus shown therein operates as follows. Concrete mix poured into a feeder hopper 1 falls onto auger feeders 2 rotated by drive machinery 3. The rotating augers 2 propel the concrete mix into a pressurized space that extends as a cross section shaping space defined by the walls of mold 4 and its side troweling beams 5 and top troweling beam 6. In this space the concrete mix fills the casting space defined by core-shaping mandrels 7 and walls 4, 5 delineating the casting mold and undergoes compaction under the compacting movement and pressure imposed thereon by auger feeders 2, core-shaping mandrels 7 and mold walls 4, 5 defining the casting mold thus eventually assuming the shape of a desired end product 8 such as a hollow-core slab.

With the progress of the casting run, proximity sensors 9 adapted to the casting machine identify the location of transverse reinforcement steels and supplementary anchor or attachment plates 10 adhered to the prestressing tendons. An incremental angle sensor 11 connected to one wheel of the casting machine makes it possible to measure and record the distance traveled by the machine. Thus, the location information of an obstacle identified in the casting direction can be submitted to a control unit 12 of the prestressing tendon guides of the casting machine. Based on the location information of identified obstacles, the tendon guides 13 traveling ahead in the casting direction are opened at a predetermined distance in advance to an impending collision with the identified supplementary parts connected to the prestressing tendons, however, in such a sequence that at least one tendon guide is kept guiding all the tendons at all times. If the identified supplementary part is a transverse reinforcing steel, the leading guides are elevated above the transverse steel. In the case that the identified obstacle is a plate facing the mold wall and adhered by a narrow fixture to the tendon, the tendon guide need only to be opened temporarily. With the progress of the casting run and after the leading guide 13 has traveled past the identified supplementary part, the guide is controlled back into its guiding position.

With the approach of the trailing guide 14 during the progress of the casting run close to the identified supplementary part, the guide is controlled open and, when necessary, the guides are elevated in the same fashion as the leading guide at the same location.

In the case the mutual distance in the casting run direction between the fixed supplementary parts happens to be substantially equal to the distance between the leading tendon guide and the trailing guide in the casting machine frame, a greater number of successive tendon guides must be used. At least one tendon guide must be arranged to guide the prestressing tendons during the time the other guides are controlled to avoid the supplementary parts.

Figure 2:
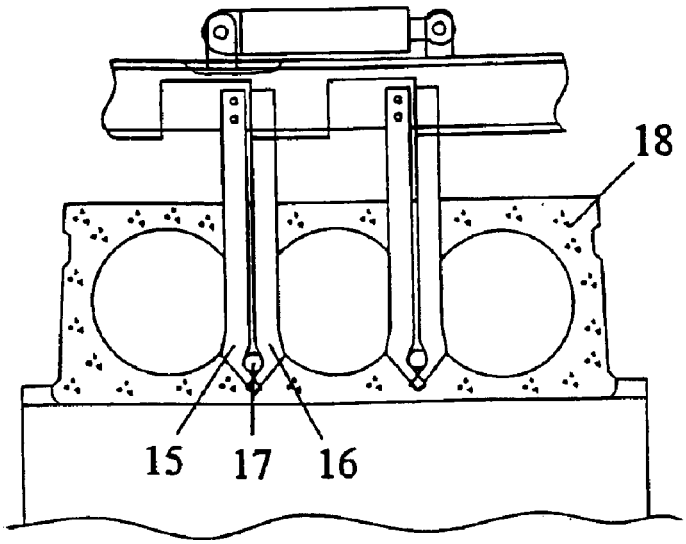
FIGS. 2 and 3 show the function of an exemplary embodiment of a prestressing tendon guide according to the invention.
Figure 3:
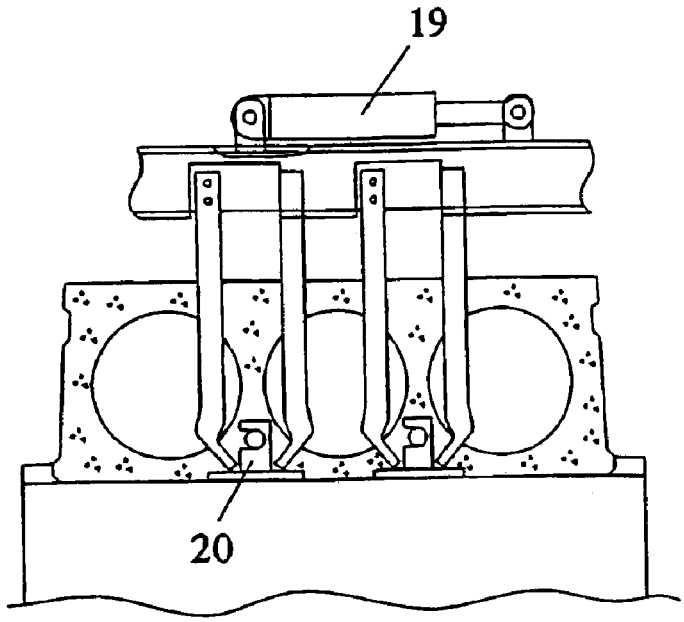

In FIGS. 2 and 3 is shown an exemplary functional sequence in the operation of the tendon guides. FIG. 2 illustrates the normal operative condition of the tendon guides.

The tendon guides comprise two opposed members 15, 16 having a prestressing tendons 17 to be guided passing therebetween. The function of the tendon guides is to keep the prestressing tendons correctly located in the cross section of the product 18 being cast irrespective of the deflecting forces imposed by the extrusion and compaction of the concrete mix.

In the situation of FIG. 3, the tendon guide control system has received information on the location of anchor plates 20 connected to the tendons thus allowing the control system to issue an open command to the tendon guides at a proper instant. In the illustrated exemplary embodiment, the tendon guides are actuated open by means of a hydraulic cylinder 19. The hydraulic cylinder makes the members 15, 16 of the tendon guides to separate from each other, whereby tendon guides can travel past the anchor plates connected to the prestressing tendons. After the anchor plates are left behind the tendon guides, the hydraulic cylinder again forces the tendon guide members against each other thus facilitating continuation of tendon guidance.

If the obstacle happens to be, e.g., a reinforcing steel tying the prestressing tendons with each other, it is necessary to elevate the tendon guides above the tendons. This operation may be accomplished, e.g., by elevating the entire tendon guidance system vertically upward or, alternatively, by rotating the support beam of the tendon guides.

The tendon guides may be driven by an electric actuator or pressurized hydraulic oil. Hence, the controllable opening/closing actuators of the tendon guides may be e.g., electric actuators or hydraulic cylinders. The operation of the actuator means is controlled on the basis of information submitted by the obstacle location sensors.

What is claimed is:

1. A method for fabricating a concrete product in a substantially horizontal slip-form casting process, in which method concrete mix is forced into a slip-form mold of a defined cross section moving progressively in the casting process so as to obtain a concrete product of a desired shape, said concrete product including prestressing tendons running in the longitudinal casting direction of the product and further including transverse reinforcing steels or other supplementary parts connected to said prestressing tendons, comprising the steps of:

guiding said prestressing tendons by at least two different points in the casting direction in such a fashion that, with the progress of the casting run so far as to reach the supplementary part connected to said prestressing tendons, a leading tendon guide is driven free from guiding a tendon for such a time that allows said leading tendon guide to travel past the supplementary part connected to the tendons and, respectively, with the progress of the casting run so far as to have said leading tendon guide passed the location of said supplementary part connected to said prestressing tendons and the casting run further proceeding so far as to have a trailing tendon guide meeting said supplementary part, driving said trailing tendon guide free from guiding a tendon for such a time that allows said trailing tendon guide to travel past the supplementary part connected to the tendons, however having during the entire casting run at least one tendon guide at all times guiding said tendon.

2. The method of claim 1, further comprising the step of controlling operation of said tendon guides on the basis of information identifying the location of said supplementary parts connected to said tendons.

* * * * *